US006149384A

United States Patent [19]

Feres

[11] Patent Number: 6,149,384

[45] Date of Patent: Nov. 21, 2000

[54] CENTRIFUGAL PUMP

[76] Inventor: Vaclav Feres, 7328 S. Serenoa Dr., Sarasota, Fla. 34241

[21] Appl. No.: 09/066,913

[22] Filed: Apr. 28, 1998

[30] Foreign Application Priority Data

Mar. 1, 1997 [DE] Germany ..... 197 18 283

[51] Int. Cl.[7] ..... F04D 1/14

[52] U.S. Cl. ..... 415/169.1; 415/88; 415/89; 415/146; 417/297

[58] Field of Search ..... 415/168.2, 168.3, 415/169.1, 89, 88, 111, 112, 146, 178, 179; 417/297

[56] References Cited

U.S. PATENT DOCUMENTS

| | | | |
|---|---|---|---|
| 3,999,882 | 12/1976 | Purton | 415/112 |
| 4,036,427 | 7/1977 | Erickson et al. | 233/10 |
| 4,044,943 | 8/1977 | Brown et al. | 233/19 A |
| 4,183,713 | 1/1980 | Erickson et al. | 415/89 |
| 4,279,571 | 7/1981 | Erickson | 415/89 |
| 4,946,349 | 8/1990 | Manabe et al. | 417/68 |

*Primary Examiner*—Edward K. Look
*Assistant Examiner*—Matthew T. Shanley
*Attorney, Agent, or Firm*—Antonelli, Terry, Stout & Kraus, LLP

[57] ABSTRACT

A centrifugal pump has a casing, an overhung-mounted rotor in the casing having a feed chamber, which centrifugally accelerates the liquid flowing centrally to it, and a discharge chamber positioned axially behind it and connected to the feed chamber in the vicinity of the inner circumference of the rotor, as well as a scoop pipe guided centrally into the discharge chamber close to the inner circumference thereof and by means of which the liquid is discharged. For the discharge of liquids from a vacuum chamber, the discharge chamber is connected by means of a line centrally introduced into it to the gas phase of the vacuum chamber, so that the liquid flowing in via the feed chamber forms on its inner circumference a liquid ring, into which is immersed the feed end of the scoop pipe, and that on the drain side the scoop pipe is closed by an automatically closing valve, which opens under the operating pressure.

29 Claims, 4 Drawing Sheets

CENTRIFUGAL PUMP

BACKGROUND OF THE INVENTION

1. Field of the Invention

The present invention relates to a centrifugal pump.

2. Description of the Prior Art

In the centrifugal pump of U.S. Pat. No. 3,795,459 the liquid is delivered centrally into a rotor and centrifugally accelerated in a feed chamber of the rotor. On the rotor circumference the liquid flows into a discharge chamber positioned axially behind it. Close to the inner circumference of the discharge chamber the accelerated liquid is removed by a scoop pipe, which converts the kinetic and static energy substantially into pressure energy, and is coaxially discharged on the pressure side. These known centrifugal scoop pipe pumps operate in the overpressure range with a complete filling of the discharge chamber and high rotor speeds. On the feed side they require at least atmospheric pressure or overpressure.

A pump disclosed in U. S. Pat. No. 4,171,182 operates with which liquid being discharged from an underpressure or vacuum chamber. A rotor rotates in a tight casing and has several delivery ducts extending outwards from the center and to whose outlet is in each case connected a short, siphon-like deflection or return with an overflow. The liquid supplied in the center of the rotor is centrifugally accelerated into the delivery ducts and inwardly deflected at the outlet thereof. At the overflow of the siphon-like deflection, the liquid runs out into the casing and is tangentially discharged from the latter. By means of a centrally introduced line, the rotor is connected to the vacuum chamber, so that there is a pressure compensation between the vacuum chamber and the low pressure side of the pump. Sealing between the interior of the rotor and the pressure side takes place by the siphon-like deflection, in much the same way as in a liquid seal pump.

It is disadvantageous in this known pump, that the sealing of the vacuum chamber is only ensured by the liquid in the siphon-like deflection or return. In the case of foaming or boiling liquids, as with suddenly occurring pressure surges, there is consequently a risk of a gas escape or air leak. The delivery of highly viscous or solids-containing liquids is also problematical.

The invention provides a centrifugal pump which operates to discharge liquids from process equipment with vacuum and, as a result, the aforementioned disadvantages do not arise.

SUMMARY OF THE INVENTION

The centrifugal pump of the invention operates so that for discharging the liquid from a vacuum chamber, a gas phase in the discharge chamber is linked by means of an open line introduced into the latter with the gas phase of the vacuum chamber and that the scoop pipe is closed on the outlet side by an automatically closing check valve, which opens under the operating pressure.

As a result of the link or connection between a gas phase of the discharge chamber and the gas phase of the process device, a pressure compensation occurs, so that the same pressure prevails in the center of the discharge chamber of the rotor as in the process device. The pump operates in the low pressure range against atmospheric pressure or the delivery head of the following process stage. The valve located at the outlet or drain side ensures that the vacuum in the pump and process device is maintained if the scoop pipe delivers no liquid or the pump is stationary. During operation the valve only opens if the liquid discharged by the scoop pipe has a pressure, which is at least slightly above the counterpressure. The pump constructed according to the invention is suitable for use in random, process engineering plants, where processes take place under vacuum and there is a need for drawing liquids out of the process. Compared with positive displacement pumps, the inventive pump has the advantage that the liquid can also contain solid particles, without damage occurring on the rotating parts of the pump. It is also possible to deliver viscous, foaming or boiling liquids. With a constant rotation, the pump delivers without any control member, even in the case of feed quantities fluctuating between zero and a maximum value.

According to a preferred development, the connecting line between the gas phase of the process device and the discharge chamber issues into the discharge chamber in the area of the rotor axis. The thickness of the liquid ring can vary within certain limits on the inner circumference of the discharge chamber without impairing the function of the pump. The thickness of the liquid ring for a constant feed height and constant speed of the rotor, is obtained as a function of the counterpressure at the check valve.

Between the vacuum chamber of the process device and the pump, the line advantageously has a gradient, in order to divert into the pump the condensate produced in a vapor phase in the vacuum chamber.

On the pressure side the scoop pipe is preferably sealed by a disk check valve, which opens against the counterpressure under the operating pressure of the pump.

The area of the pump connected to the gas phase of the vacuum chamber is sealed against the atmosphere by means of a slip ring seal in the casing. According to a preferred development the slip ring seal, which can be constructed both axially and radially, is immersed in a lubricating sealing liquid located within the closed chamber of the casing. This ensures that the pump can also be operated "dry", i.e. without any delivery liquid supply.

As liquids in process equipment, e.g. vacuum evaporators, frequently have high temperatures, the sealing liquid also fulfils a cooling function, which in particular protects the slip ring seal against undesired heating.

According to a variant, the rotor is mounted by means of the slip ring seal in the casing. The slip ring seal seals the feed side of the rotor against the casing, which ensures that the casing remains free from delivery fluid.

According to another variant, the casing has at least two areas, which are sealed against one another by means of the slip ring seal located on the rotor drive shaft and the casing area receiving the rotor is connected to the rotor interior and is sealed in liquid-tight manner against the same by a rotating, contact-free gap seal or gland. Through the placing of the slip ring seal on the rotor drive shaft, there is no direct contact between the slip ring seal and the liquid to be delivered and consequently there is no deterioration to the service life of the seal as a result of the dangerous properties of the delivery liquid (heat, aggressiveness).

The gland according to this variant has ribs with axial holes and chambers enclosed by them, so that spray penetrating the gland from the rotor can be returned to the latter as a result of the rotary movement of the gland.

According to a preferred development, there is a tangential connection to the casing area connected to the rotor interior, by means of which the liquid, which has penetrated into the casing area by means of the gland, can be removed. According to a preferred development, the tangential connection is connected by means of a check valve to the pump feed.

According to the first variant the sealing liquid travels in a closed circuit with a feed and drain on the pump casing, which carries the sealing liquid through a cooling device located within the pump casing and preferably a spiral cooler or radiator concentrically surrounding the chamber.

The conveying of the sealing liquid in the circuit takes place by means of a pump rotor, which is located in the closed chamber and rotates with the rotor. The pump rotor has, in a preferred development, drivers for the slip rings of the slip ring seal.

The part of the sealing liquid circuit outside the pump casing advantageously has a filter and a level indicator, which is used for checking the sealing liquid during operation and on topping up the liquid.

According to another preferred development of the invention, the pump can be constructed with a radially positioned slip ring seal and a correspondingly shorter, axial overall length.

With a view to a simple, rapid maintenance or cleaning of the scoop pipe, a detachable attachment or fixture is placed on the feed-side cover of the pump casing. It has a holding pipe directed into the pump interior and on which the scoop pipe is positioned in non-rotary manner and detachably fixed. After releasing the attachment, the holding pipe and scoop pipe can be removed from the rotor and the scoop pipe can be removed from the holding pipe for replacement purposes or for cleaning in the case of blockages.

Since, as has already been stated, the pump according to the invention must also be suitable for the discharge of very hot and optionally also boiling process liquids, e.g. from a fine vacuum evaporator, on its drive side the rotor has an air-cooled hub for connection to the drive shaft.

BRIEF DESCRIPTION OF THE DRAWINGS

The invention is described in greater detail hereinafter relative to embodiments and the attached drawings, wherein show.

DETAILED DESCRIPTION OF THE DRAWINGS

Figure 1:
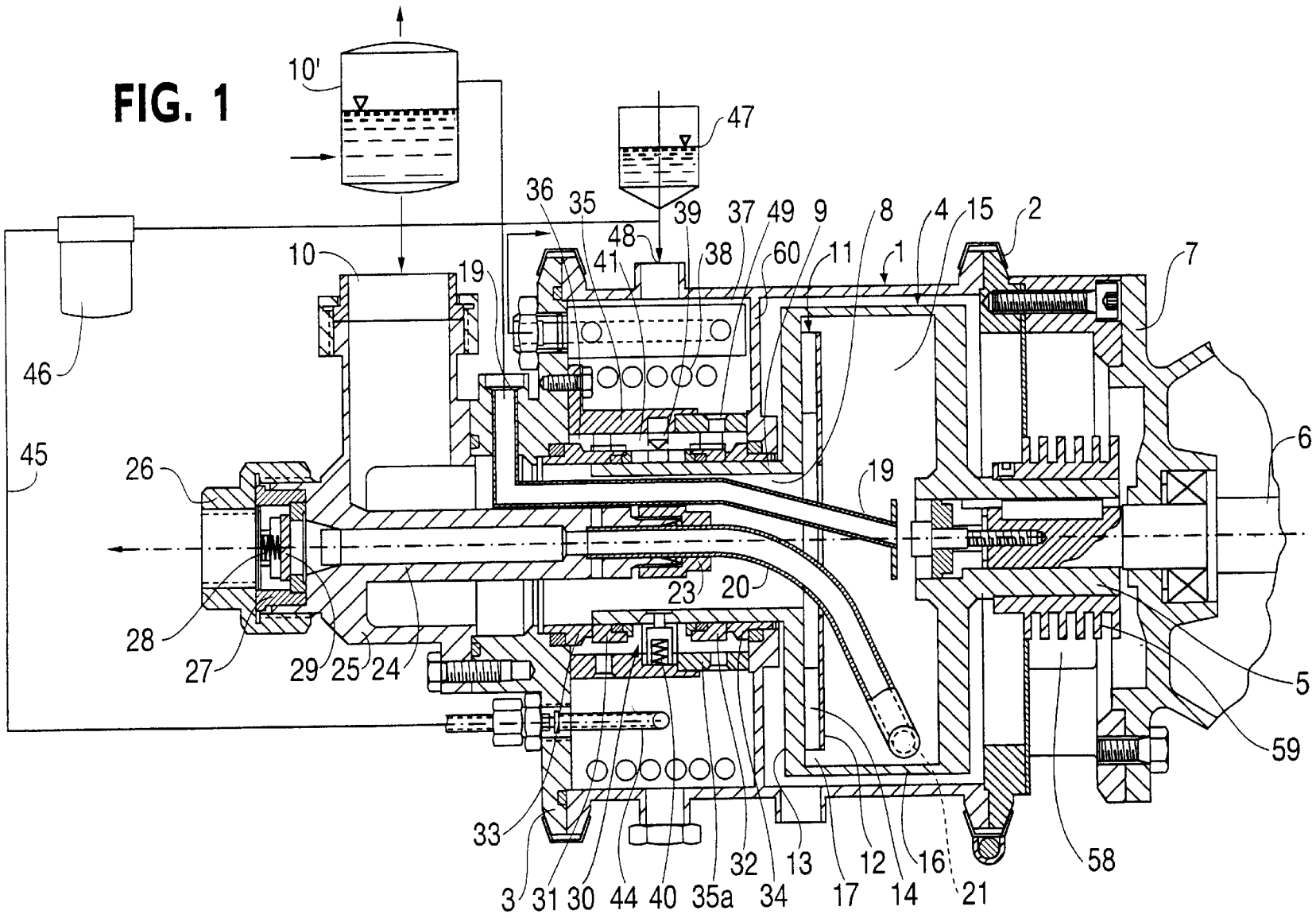
FIG. 1 A longitudinal section through the centrifugal pump with an axial construction of the slip ring seal.
Figure 2:
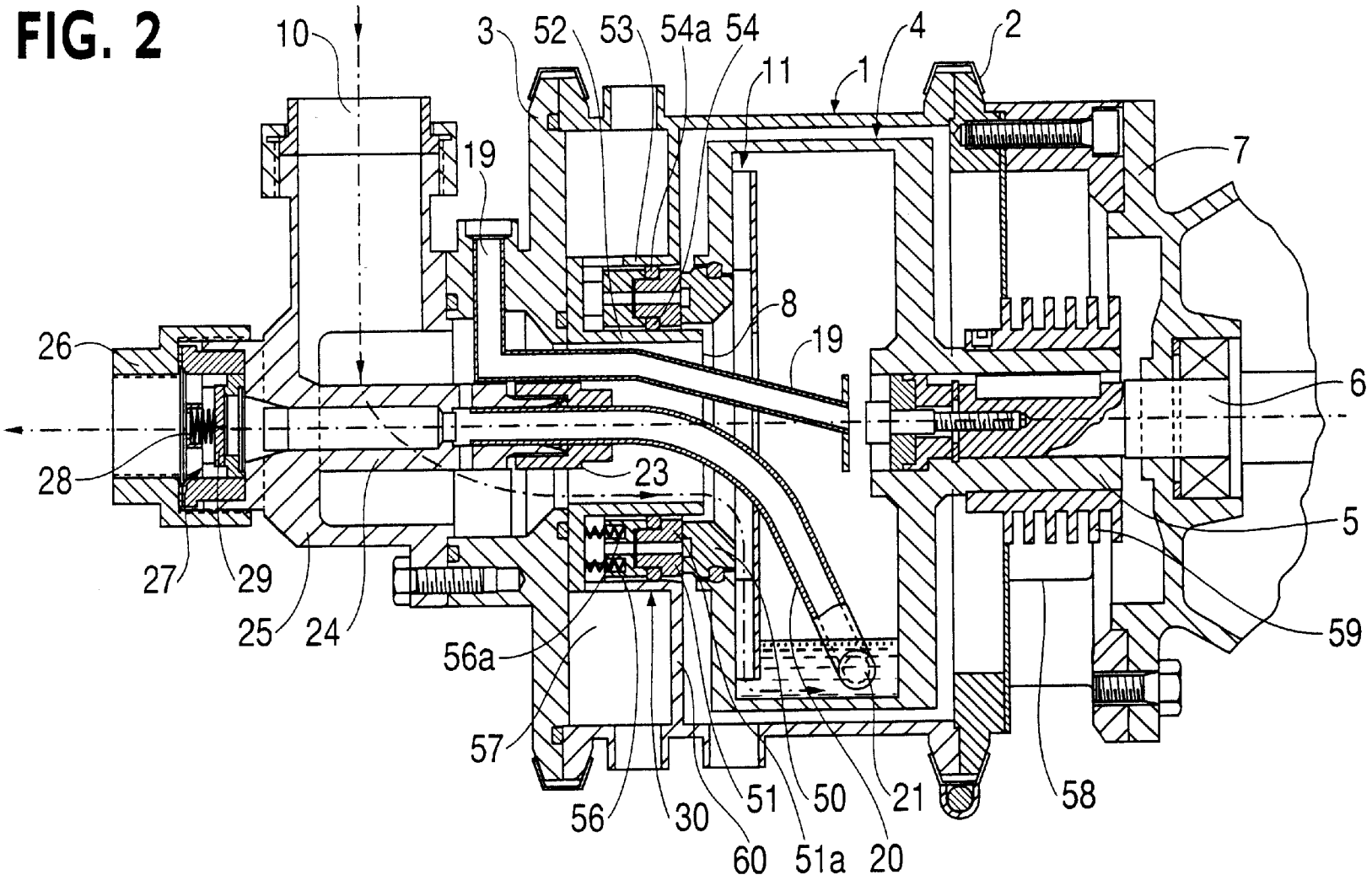
FIG. 2 A longitudinal section through the centrifugal pump with a radial construction of the slip ring seal.

According to FIGS. 1 and 2, the centrifugal pump has a casing 1 with a substantially cylindrical cross-section, which at each of its ends is closed by a cover 2, 3. Within the casing 1 is provided a partition 60, which subdivides the casing interior into an area, where the rotor runs under ambient conditions, and a second area sealed with respect to the first area and the environment, in which are inter alia located the devices for sealing the vacuum area of the pump. The rotor 4 has on its one end face a hub 5 for the connection of the drive shaft 6, which is mounted in a frontal termination 7 of the casing 1. The rotor 4 has on the end face facing the drive shaft 6 a central opening 8, which in the embodiment according to FIG. 1 is bounded by a hollow shaft 9, by means of which the rotor 4, as will be described hereinafter, is sealed in the casing 1. By a means of the opening 8 and the hollow shaft 9, the rotor 4 is connected to a feed 10 by means of which the pump is connected to the liquid outlet of a process plant 10', e.g. a vacuum evaporator. The liquid to be discharged from the process plant passes by means of the feed 10 to the pump.

On the feed side and connecting on to the opening 8, the rotor 4 has a feed chamber 11, which is separated from the remaining rotor by a partition 12. Between the partition 12 and the closed end wall 13 of the rotor 4 can be inserted several webs 14, which act as radial blades. On the other side of the partition 12 the rotor 2 forms a discharge chamber 15. The partition 12 does not extend completely up to the circumferential wall 16 of the rotor 4, so that a free overflow ring 17 remains, by means of which the discharge chamber 15 is connected to the feed chamber 11.

Into the center of the rotor 4 and namely into the discharge chamber 15 issues a line 19, which passes outwards through the hollow shaft 9 and through the front cover 3 of the casing 1. This line 19 is tightly connected with the gas phase of the process plant under vacuum and towards the pump has a gradient. The line 19 passes substantially centrally through the partition 12.

Through the hollow shaft 9 and opening 8 is also passed into the rotor 4 a scoop pipe 20 and it passes through the partition 12 and is bent outwards in the discharge chamber in such a way that at its feed end 21 it is oriented against the rotation direction of the rotor, e.g. runs roughly parallel to the circumferential wall 16 of rotor 4. At its other end, with which the scoop pipe is roughly in the axis of the rotor 4, it is detachably fixed by a screwed pipe coupling 23 to a holding pipe 24, which is in turn part of an attachment or fixture 25, which is detachably fixed to the front cover 3 of the casing 1 and enclosed the feed 10. On the attachment 25 is also located the pump outlet or drain 26, which has a closure member in the form of a disk check valve 27 with a valve disk 29 loaded by a spring 28. When the pump is stationary or, if the scoop pipe is delivering no liquid, the check valve hermetically seals the rotor against the environment, so that by means of the pump drain 26 there can be no inrush of air into the process plant.

The rotor 4 is sealed in the casing 1 by means of a slip ring seal 30, which in the construction according to FIG. 1 is in the form of an axial double slip ring seal, which is positioned between the cover 3 and the dividing wall 60 of the casing 1. It has two slip rings 31, 32 positioned in spaced manner on the hollow shaft 9 of the rotor 2 and in each case outwardly displace counterrings 33, 34, the rings 31, 33 and 32, 34 forming on their facing, lapped end faces the sealing faces and for this purpose are under the action of not shown compression springs.

The rings 31 to 34 are concentrically surrounded by a split sleeve 35, 35*a*, whose two parts are fixed in the casing 1. The chamber 36 formed between the slip rings 31 to 34 and the sleeve 35, 35*a* receives a lubricating sealing liquid which, in the represented embodiment, simultaneously serves as a coolant. For this purpose a further chamber 37 containing a spiral cooler or radiator 38, through which flows a heat exchange fluid, is arranged concentrically to the chamber 36. Between the two slip ring pairs 31, 33 and 32, 34 within the chamber 36 is placed a pump rotor 39, which is connected in non-rotary manner by a spring clip 40 to the hollow shaft 9 of the rotor 4 and is guided on its circumference in an annular groove of the sleeve 35. On the pump rotor 39 are located driving pins 41, which engage on and drive the inner slip rings 31, 32.

Figure 5:
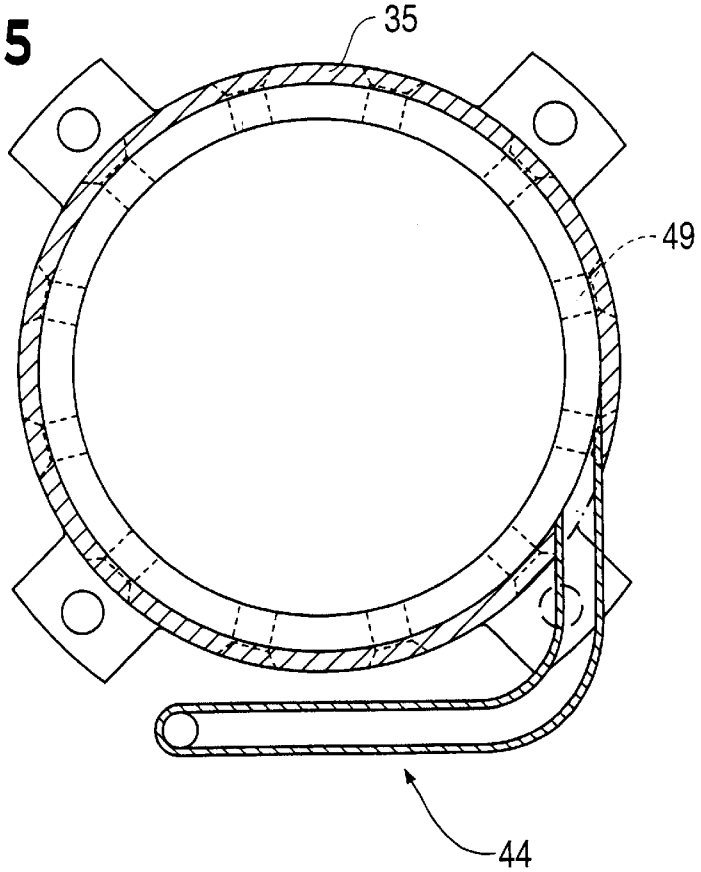
FIG. 5 A cross-section through the sleeve receiving the chamber with the sealing liquid.
Figure 3:
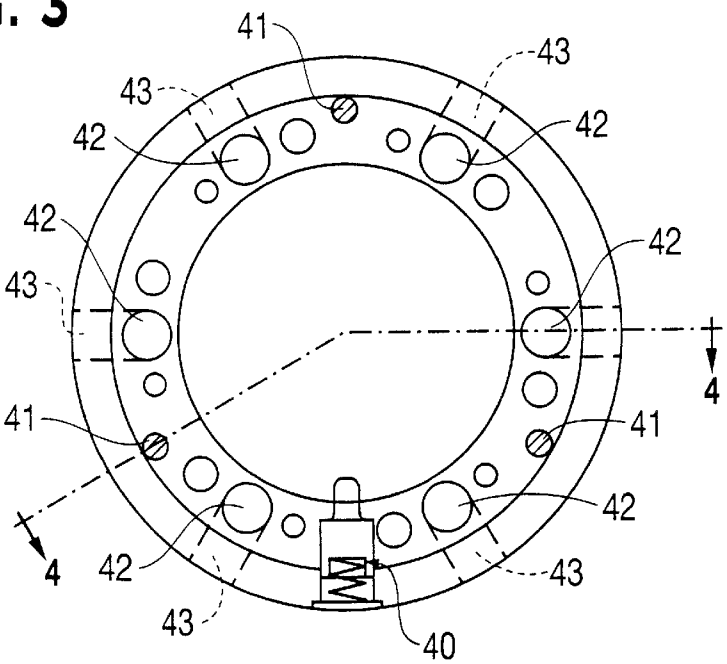
FIG. 3 A view of the pump rotor in the sealing liquid circuit.
Figure 4:
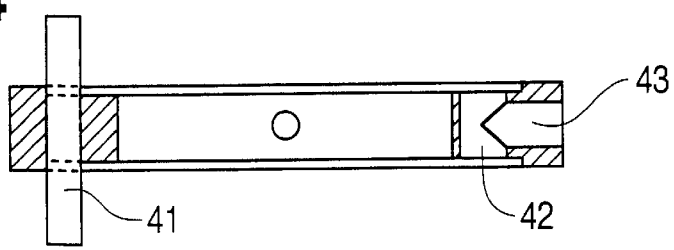
FIG. 4 A section IV—IV according to FIG. 3.

As can be gathered from FIG. 3, the pump rotor has three driving pins 41, which are firmly seated in coaxial holes or bores. The pump rotor also has several coaxial holes 42, to which is in each case connected a radial hole 43. The sealing liquid in the chamber 36 is fed by means of the coaxial holes 42 and centrifugally accelerated in the radial holes 43. To the sleeve 35 is tangentially connected a discharge pipe 44 (FIG. 5), through which the sealing liquid accelerated by the pump rotor is discharged in a circuit 45 (FIG. 1), in which are located a filter 46 and a level indicator 47, e.g. in the form of a sight glass. The sealing liquid passes via feed 48 back into the casing 1, namely into the outer chamber 37 with the spiral cooler 38 and from there, via the holes 49, back into the inner chamber 36 with the slip rings 31 to 34.

The operation of the pump will now be described. From the process plant 10', the liquid to be discharged is supplied to the pump by means of the feed 10 and hollow shaft 9. The liquid entering the feed chamber 11 of the rotor 4 by means of the opening 8 is centrifugally accelerated and passes via the overflow ring 17 into the discharge chamber 15, where it is spread in ring-like manner on the inside of the circumferential wall 16 of the rotor 4. The scoop pipe 20 immersed with the feed end 21 in the liquid ring removes liquid from the ring and converts the kinetic and static energy of the liquid into pressure energy. The liquid scooped from the feed end 21 passes through the scoope pipe and holding pipe 24 to the check valve 27 which, under the operating pressure, opens the pump, so that the liquid is discharged via the drain 26.

During the operation of the pump, the sealing liquid of the slip ring seal 30 is constantly circulated, filtered and cooled by means of the pump rotor 39, which is driven by the rotor 4. Therefore the pump can also run "dry", i.e. without any liquid supply and even under elevated temperature in the pump chamber. Therefore the pump has good antiseizure properties.

If the pump is stopped or the rotary liquid ring collapses, because e.g. no further liquid is being supplied from the process plant 10', the check valve 27 closes, so that the vacuum from the process plant prevailing in the rotor is maintained.

The embodiment according to FIG. 2 differs from that according to FIG. 1 essentially only with respect to the sealing of the rotor. Therefore for the same parts the same reference numerals are used and with respect to these parts reference is made to the description of FIG. 1. Unlike in FIG. 1, on the end face opposite to the drive shaft 6, the rotor 4 has no hollow shaft and the slip ring seal 30 is constructed as a double radial seal. It comprises a slip ring 50 tightly inserted in the rotor opening 8 and which cooperates by means of two concentric ring faces with two concentric counterrings 51, 51*a* in the casing 1. The counterrings 51, 51*a* are placed between an inner sleeve 52 and an outer sleeve 53 of the casing, accompanied by the interposing of two concentric O-rings 54, 54*a* and are forced by means of two spring-loaded, concentric thrust rings 56, 56*a* against the slip ring 50. At the back, the slip ring seal is connected to a chamber 57, which once again contains a lubricating and cooling sealing liquid. The operation of the pump is the same as described relative to FIG. 1. Diverging therefrom, the lubricating sealing liquid is not circulated with its own pump (not shown in FIG. 1).

In order to avoid a heat dissipation on the drive side in the case of liquids with a very high temperature, the hub 5 of the rotor 4 serving to connect the drive shaft 6 is provided with a ribbed radiator or cooler 59, which rotates with the hub in a space open to the environment between the front cover 2 of the casing and the termination 7, together with the main bearing. The ribbed radiator 59 gives off the heat to the ambient air in the chamber 58.

Figure 6:
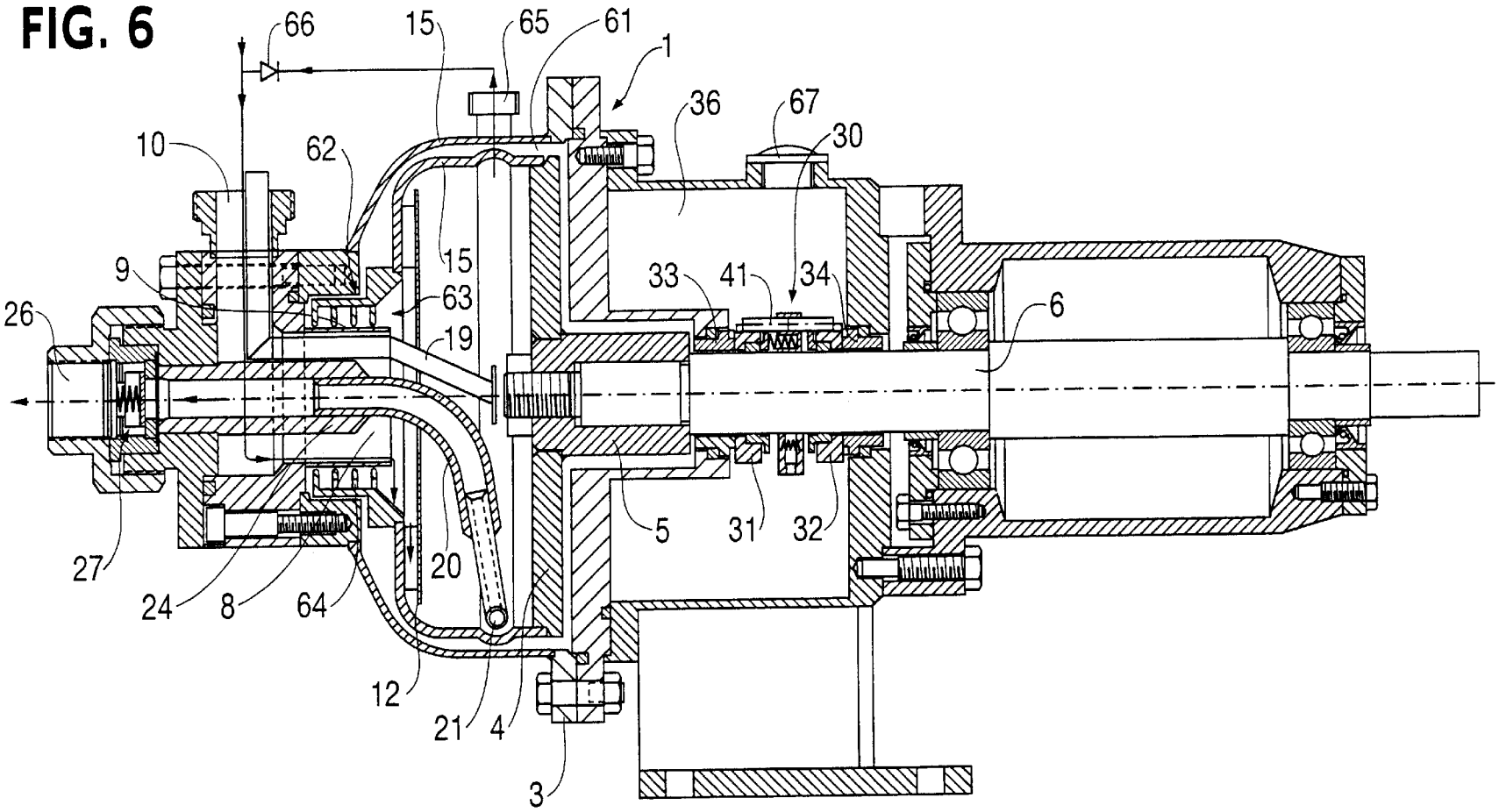
FIG. 6 A longitudinal section through the centrifugal pump according to an alternative embodiment.

FIG. 6 shows an alternative embodiment of the scoop pipe pump, the same parts having the same reference numerals as in the preceding drawings and only the differences compared with the preceding embodiment will be described hereinafter.

In this embodiment an area 61 of the casing 1 is connected to the discharge chamber 15 of the rotor 4 and is sealed in liquid-tight, but not gas-tight manner with respect thereto by a gland 62.

The gland rotating with the rotor 4 and contact-free with respect to the hollow shaft 9, has ribs 63, which enclose gaps, each rib having at least one axial hole 64. By means of said axial hole, spray entering the gland in the rotor is fed back into the latter through the rotary movement of the gland.

By means of a tangential connection 65 and a further check valve 66, liquid which has penetrated the casing area 61 by means of the gland is led off to the feed inlet 10 of the pump.

The casing area 61 connected to the rotor interior is, according to the embodiment shown in FIG. 6, sealed against the atmosphere by means of an axial double slip ring seal 30, constructed in accordance with the slip ring seal described in FIG. 1 and located on the drive shaft 6 of the rotor 4. Thus, the vacuum corresponding to the gas phase of the not shown vacuum chamber connected by means of the line 19 to the interior of the casing 1 is extended to the interior of the rotor 4 and to the casing area 61.

According to this embodiment, for receiving the lubricating sealing liquid, the chamber 36 is only constructed with one feed and removal connection 67. There is no need for a circuit guidance with cooling for the sealing or lubricating liquid, because the slip ring seal according to the variant of FIG. 6 does not come into contact with possibly hot and/or aggressive delivery liquid.

What is claimed is:

1. A centrifugal pump comprising a casing, an overhung-mounted rotor rotating about an axis in the casing, a feed chamber centrifugally accelerating a liquid flowing centrally into the feed chamber, a discharge chamber positioned axially behind and connected to the feed chamber in an area of an inner circumference of the rotor, a scoop pipe centrally guided in the discharge chamber having a drain side and a feed end which is immersed in the liquid close to an inner circumference of the discharge chamber so that the liquid is discharged, a vacuum chamber, an open line coupling the vacuum chamber to the discharge chamber and an automatically closing check valve closing the scoop pipe on a drain side under an operating pressure.

2. A centrifugal pump according to claim 1, wherein the open line opens into the discharge camber in a vicinity of the axis of the rotor.

3. A centrifugal pump according to claim 1, wherein the open line has a pressure gradient towards the pump.

4. A centrifugal pump according to claim 1, wherein the check valve is a disk check valve.

5. A centrifugal pump according to claim 1, wherein a part of the pump connected to a gas phase of the vacuum chamber is sealed against atmosphere by a slip ring seal in the casing.

6. A centrifugal pump according to claim 5, wherein the slip ring seal has an axial or radial construction.

7. A centrifugal pump according to claim 5, further comprising a sealing and lubricating liquid source coupled to the slip ring seal which provides sealing and lubricating fluid with the sealing and lubricating liquid from the source circumferentially immersing the slip ring seal.

8. A centrifugal pump according to claim 7, wherein the sealing liquid source is located in a sealed chamber of the casing and the sealed chamber has a boundary formed by the slip ring seal.

9. A centrifugal pump according to claim 8, wherein the rotor is mounted in a sealed manner in the casing by a slip ring seal.

10. A centrifugal pump according to claim 1, wherein the casing has at least two areas which are sealed against one another by the slip ring seal placed on a drive shaft of the rotor, one casing area having a rotor interior connected thereto and the rotor on a feed side having a rotating contact-free gland relative to a casing area connected thereto.

11. A centrifugal pump according to claim 5, wherein the casing has at least two areas which are sealed against one another by the slip ring seal placed on a drive shaft of the rotor, one casing area having a rotor interior connected thereto and the rotor on a feed side having a rotating contact-free gland relative to a casing area connected thereto.

12. A centrifugal pump according to claim 10, wherein the gland has ribs with axial holes and chambers enclosed by the axial holes.

13. A centrifugal pump according to claim 11, wherein the gland has ribs with axial holes and chambers enclosed by the axial holes.

14. A centrifugal pump according to claim 10, wherein the casing area connected to the rotor interior has a tangential connection for liquid removal.

15. A centrifugal pump according to claim 11, wherein the casing area connected to the rotor interior has a tangential connection for liquid removal.

16. A centrifugal pump according to claim 14, wherein the tangential connection is connected to a feeding side of the pump by a check valve.

17. A centrifugal pump according to claim 15, wherein the tangential connection is connected to a feeding side of the pump by a check valve.

18. A centrifugal pump according to claim 8, wherein the sealing chamber is located in a closed circuit having a feed and drain.

19. A centrifugal pump according to claim 18, further comprising a pump rotor rotating with the rotor and the sealing chamber delivers sealing liquid to the circuit.

20. A centrifugal pump according to claim 19, wherein the pump rotor axially sucks in and discharges the sealing liquid tangentially from the sealing chamber.

21. A centrifugal pump according to claim 19 wherein the pump rotor has drivers acting on rings of the slip ring seal.

22. A centrifugal pump according to claim 18, wherein the closed circuit has a filter.

23. A centrifugal pump according to claim 18, wherein the closed circuit has a level indicator.

24. A centrifugal pump according to claim 18, further comprising a cooling device for the sealing liquid provided in the closed circuit.

25. A centrifugal pump according to claim 24, wherein the cooling device concentrically surrounds the sealing chamber and is located within the casing.

26. A centrifugal pump according to claim 25, wherein the sealing chamber has a sealing liquid feed connecting the sealing chamber to the cooling device.

27. A centrifugal pump according to claim 1, further comprising a feed-side cover of the casing provided with a detachable attachment having a holding pipe projecting centrally into the casing and on which is positioned the scoop pipe in non-rotary, detachably fixed manner.

28. A centrifugal pump according to claim 27, wherein the scoop pipe is removably mounted in the casing and is removable when the detachable casing is removed.

29. A centrifugal pump according to claim 1, wherein the rotor has an air-cooled hub connected to a drive shaft mounded in the casing.

* * * * *